US005363815A

United States Patent [19]

Pretzsch et al.

[11] Patent Number: 5,363,815

[45] Date of Patent: Nov. 15, 1994

[54] COOLING AIR BLOWER WITH COMBUSTION AIR CHANNEL

[75] Inventors: Peter Pretzsch, Schorndorf; Michael Kein, Korb; Peter Linsbauer, Remshalden, all of Germany

[73] Assignee: Andreas Stihl, Waiblingen, Germany

[21] Appl. No.: 112,663

[22] Filed: Aug. 25, 1993

[30] Foreign Application Priority Data

Aug. 26, 1992 [DE] Germany ..... 4228450

[51] Int. Cl.[5] ..... F01P 1/02

[52] U.S. Cl. ..... 123/41.7; 123/198 E; 55/437; 55/DIG. 28

[58] Field of Search ..... 123/41.56, 41.65, 41.9, 123/198 E; 55/337, 437, 473, 392, DIG. 28; 96/208, 209

[56] References Cited

U.S. PATENT DOCUMENTS 4,233,043 11/1980 Catterson ..... 55/DIG. 28
4,261,302 4/1981 Sheldon ..... 123/41.56
4,946,482 8/1990 Tamba et al. ..... 55/DIG. 28

FOREIGN PATENT DOCUMENTS 442232 12/1985 Sweden .

*Primary Examiner*—Noah P. Kamen
*Attorney, Agent, or Firm*—Robert W. Becker & Associates

[57] ABSTRACT

A cooling air blower for a combustion engine for a two-stroke engine of a hand-held working tool has a cooling air channel for supplying cooling air to a combustion engine and a blower fan for conveying air into the cooling air channel. A combustion air channel branches off the cooling air channel for guiding combustion air to an intake member of the combustion engine. The combustion air channel has a section extending adjacent to the cooling air channel. The combustion air channel has furthermore an air intake socket within that section, the air intake socket being narrower than the cooling air channel and extending transverse, when viewed in a plan view, to a main air flow direction of the cooling air channel into the cooling air channel. The air intake socket is positioned at a slant relative to the main air flow direction and has an inlet opening located on a side of the intake socket facing away from the blower fan. The inlet opening allows passage of air from the cooling air channel into the combustion air channel.

14 Claims, 10 Drawing Sheets

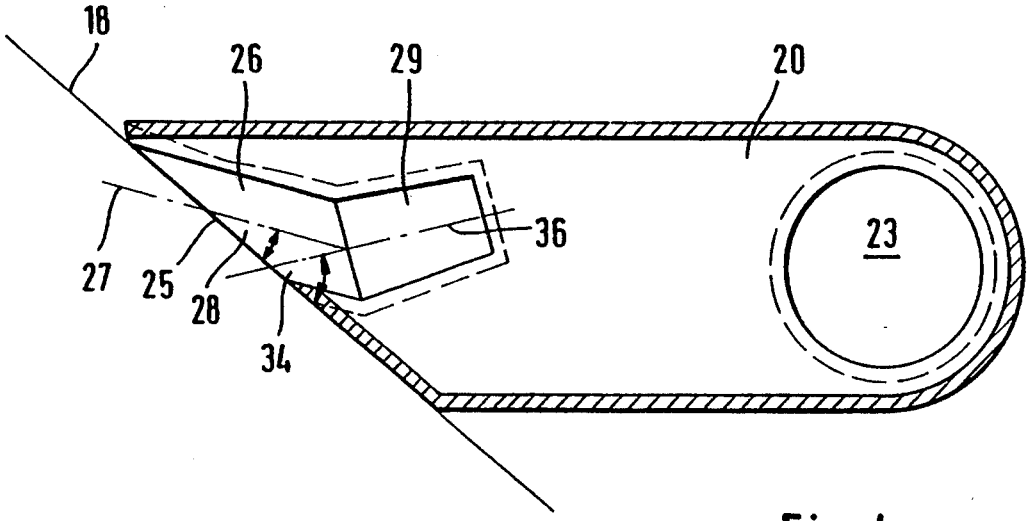
Fig. 4
Fig. 8
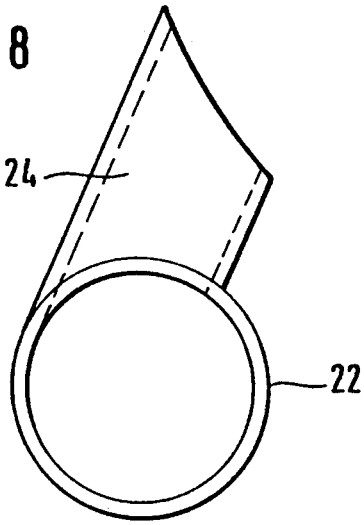
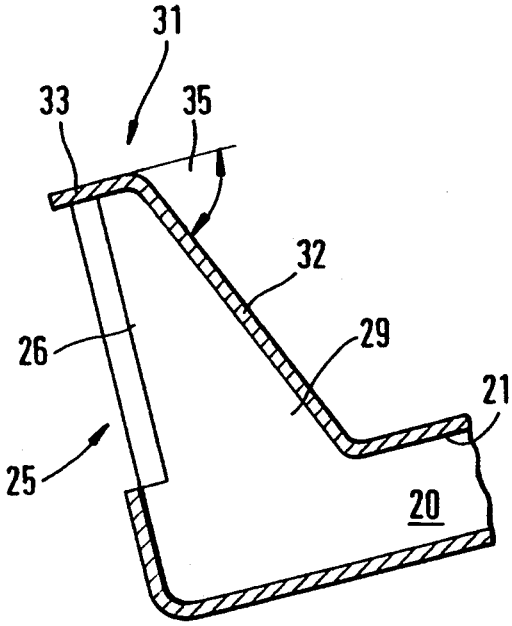
Fig. 7
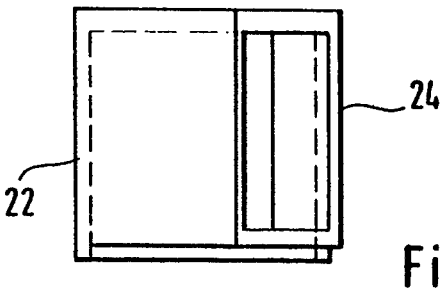
Fig. 9

COOLING AIR BLOWER WITH COMBUSTION AIR CHANNEL

BACKGROUND OF THE INVENTION

The invention relates to a cooling air blower for a combustion engine, especially for two-stroke engines for hand-held tools such as motor-driven chain saws, blowing devices, cutting-off machines etc., which have a blower fan that supplies cooling air for the combustion engine to a cooling air channel. The cooling air blower further has a combustion air channel branching off the cooling air channel which supplies the intake member of the combustion engine with combustion air needed for operation, whereby the combustion air channel has one section that is adjacent to the cooling air channel and is provided with an inlet opening for allowing air from the cooling air channel into the combustion air channel.

In a known cooling air blower according to Swedish printed document 442 232 the combustion air channel is positioned approximately in a plane parallel to the radial blower fan and limits axially a cooling air spiral surrounding the blower fan. An annular slot is provided within the combustion air channel and is facing the cooling air channel, whereby the annular slot is covered relative to the blower fan by a baffle plate in order to prevent a direct introduction of dirt particles contained within the cooling air into the combustion air channel. Due to the great extension of the annular slot a considerable disturbance of the cooling air flow within the cooling air spiral occurs which may result in an impairment of the cooling effect of the combustion engine. Furthermore, the annular slot is positioned close to the exit of the cooling air spiral where a relatively high static pressure is present which favors the transfer of dirt particles from the cooling air flow into the combustion air channel.

It is therefore an object of the present invention to improve a cooling air blower of the aforementioned kind such that with a relatively low disturbance of the cooling air flow even great amounts of substantially dirt particle-free combustion air can be branched off.

BRIEF DESCRIPTION OF THE DRAWINGS

This object, and other objects and advantages of the present invention, will appear more clearly from the following specification in conjunction with the accompanying drawings, in which:

FIG. 4 shows in an enlarged representation an inventive combustion air channel with air intake socket;

FIG. 7 shows a section along the line VII—VII in FIG. 1;

FIG. 8 shows a view of a connector with a connecting socket to an air filter housing;

FIG. 9 shows a side view of the connector according to FIG. 8;

SUMMARY OF THE INVENTION

Figure 1:
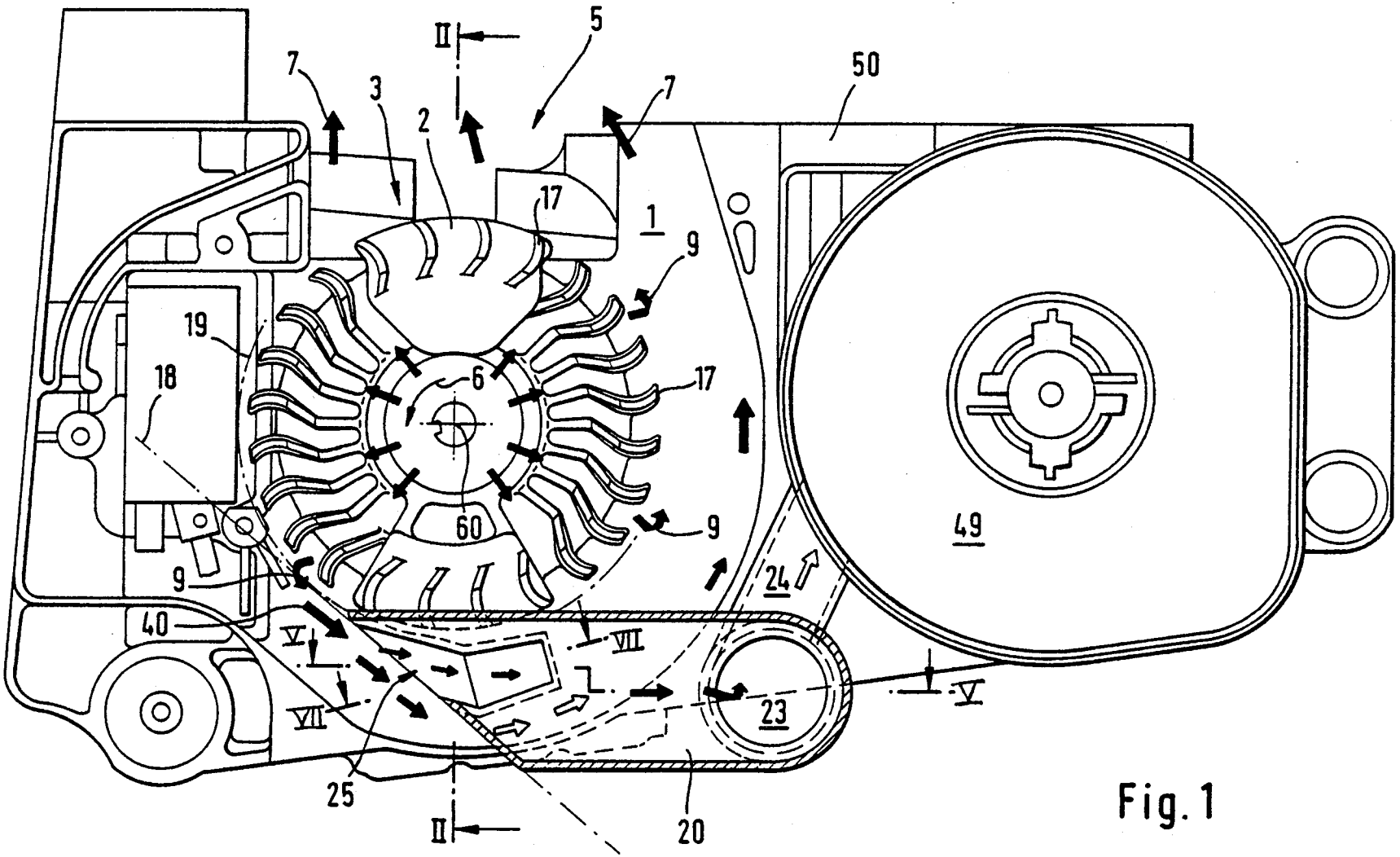
FIG. 1 shows in section a partial view of a cooling air blower with a combustion air channel positioned on a tool housing.

The cooling air blower for a combustion engine according to the present invention is primarily characterized by:

A cooling air channel for supplying air to a combustion engine for cooling;

A blower fan for conveying air into the cooling air channel;

A combustion air channel branching off the cooling air channel for guiding air for combustion to an intake member of the combustion engine;

The combustion air channel having a section extending adjacent to the cooling air channel; and The combustion air channel having an air intake socket within the section, the air intake socket being narrower than the cooling air channel and extending transverse, when viewed in a plan view, to a main air flow direction of the cooling air in the cooling air channel, the air intake socket positioned at a slant relative to the main air flow direction and having an inlet opening, located on a side of the intake socket facing away from the blower fan, for allowing passage of air from the cooling air channel into the combustion air channel.

Preferably, the air intake socket substantially extends over the entire axial height of the cooling air channel. The air intake socket has a free end remote from the combustion air channel, the free end being spaced at a distance x from the inner wall of the cooling air channel. In an alternative embodiment, the air intake socket has a free end remote from the combustion air channel, the free end being flush with an inner wall of the cooling air channel.

The inlet opening is preferably located in a plane forming a tangent to a circle concentric to the blower fan, the circle having a diameter that is greater than an outer diameter of the blower fan. Expediently, the plane is parallel to an axis of rotation of the blower fan.

The inlet opening extends preferably over the entire width and the entire height of the air intake socket.

Advantageously, the air intake socket has an intake section adjacent to the inlet opening, the intake section having a longitudinal center axis extending at a first angle of substantially 20° to 35° to the main air flow direction. The air intake socket furthermore has a transition section adjacent to the intake section, the transition section having a bottom portion that ascends from the intake section to the combustion air channel. Preferably, the intake section and the transition section form a substantially linear channel. Expediently, the transition section is positioned at a second angle relative to the main air flow direction, the second angle being greater than the first angle. Advantageously, the transition section tapers off in the circumferential direction of the blower fan.

In another embodiment of the present invention, the combustion air channel has a plurality of the aforedescribed air intake sockets arranged one after another in the longitudinal direction of the cooling air channel. Preferably, the air intake sockets are equidistantly spaced from one another.

Advantageously, the air intake socket, with respect to the main air flow direction, is positioned within the forward quarter of the cooling air channel.

The air intake socket extending into the cooling air channel disturbs the air flow within the cooling air channel only to a small extent, whereby preferably due to an increased diameter of the cooling air spiral the volume stream of the supplied cooling air for cooling the combustion engine is maintained at a sufficient level. The radial extension of the air intake socket corresponds to approximately half the width of the cooling air channel whereby the effective air inlet cross-section is adjusted to the air consumption of the engine. Due to the slanted arrangement relative to the main air flow direction, it is ensured that the combustion air flow branched off via the inlet opening is substantially free of dirt particles. For this purpose, the inlet opening is preferably arranged within a plane which is positioned at a tangent to a circle that is concentric to the axis of rotation of the blower fan. This plane is preferably parallel to the axis of rotation of the blower fan. The air intake socket is arranged in the vicinity of the blower fan and is spaced at a greater distance from the outer wall of the cooling air channel than from the blower fan. In order to be able to branch off a sufficient amount of combustion air, the inlet opening extends preferably over the entire width and the entire height of the air intake socket.

The inlet opening connects to an intake section having a longitudinal center axis that extends at an acute angle of preferably approximately 20° to 35° to the main air flow direction. The bottom of the intake section is preferably positioned in a common plane with the backside of the blower fan facing the crank shaft of the combustion engine. The intake section is connected to a transition section having a bottom that ascends from the intake section to the combustion air channel so that the combustion air is essentially diagonally guided into the combustion air channel. The transition section is arranged at an angle to the main flow direction such that this angle is greater than the acute angle between the main air flow direction and the longitudinal center axis of the intake section.

DESCRIPTION OF PREFERRED EMBODIMENTS

The present invention will now be described in detail with the aid of several specific embodiments utilizing FIGS. 1 through 18.

Figure 2:
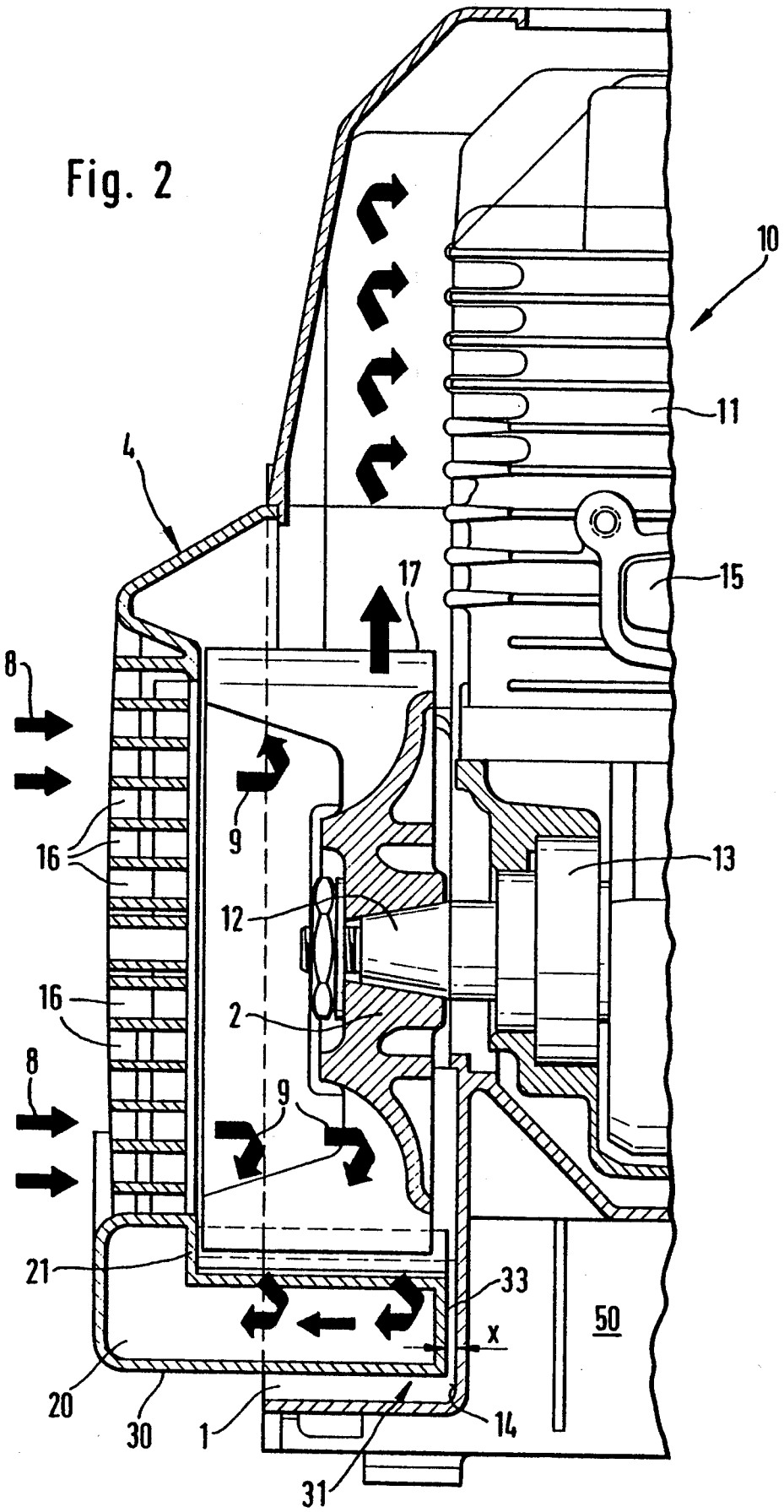
FIG. 2 shows a section along the line II—II in FIG. 1.
Figure 3:
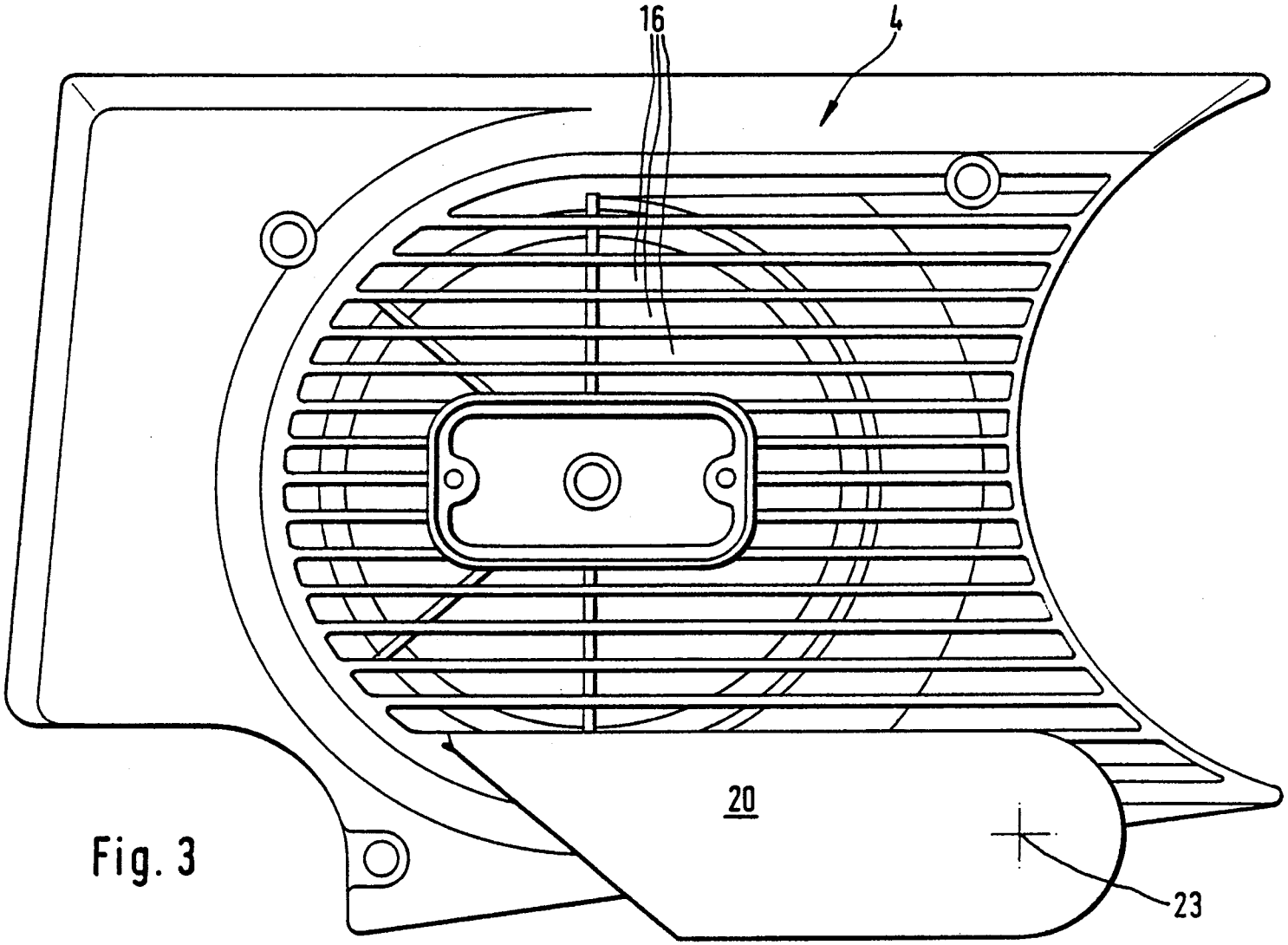
FIG. 3 shows a plan view of a cover of the cooling blower according to FIG. 2.
Figure 5:
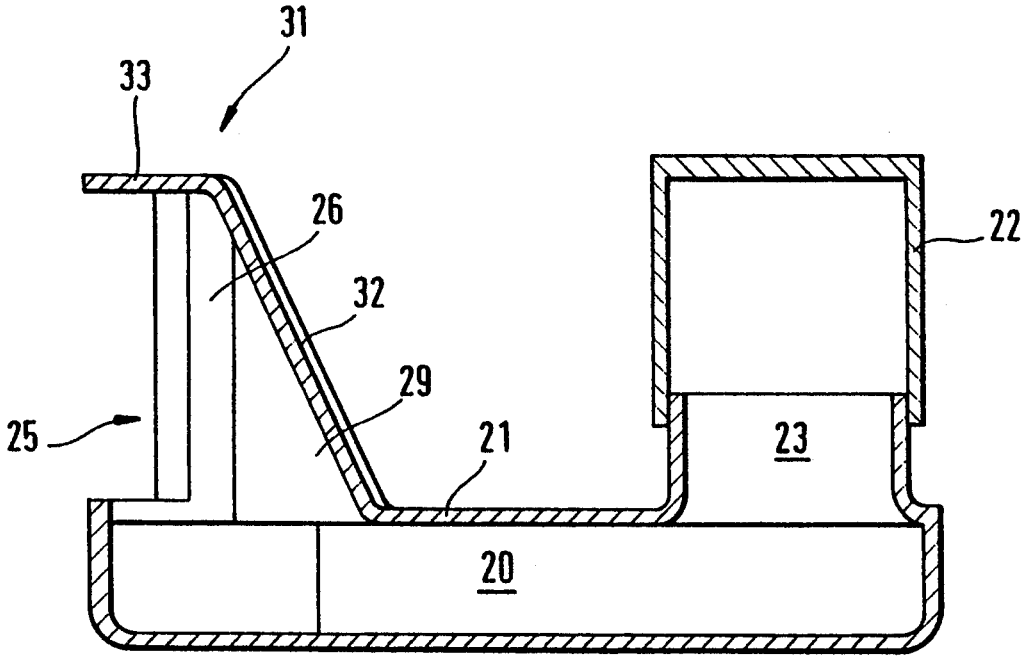
FIG. 5 shows a section along the line V—V in FIG. 1.

The housing part 50 represented in FIG. 1 is a portion of a hand-held working tool such as a motor-driven chain saw, a blowing device, a cutting-off device, a free-cutting device etc. A cooling air channel 1 is formed within the housing which in the shown embodiment is in the form of a cooling air spiral. In the center of the cooling air spiral 1 a blower fan 2 of a cooling air blower 3 is arranged which, as shown in FIG. 2, is covered by a blower cover 4. The blower cover 4 also covers the cooling air spiral so that the cooling air spiral 1 forms a U-shaped annular channel open toward the blower fan 2. The cooling air spiral 1 is open over a certain circumferential portion which forms a cooling air exit 5 through which the cooling air, transported by the blower fan 2 in its direction of rotation 6 and in the longitudinal direction of the cooling air spiral 1 that is indicated by the arrows 7 in FIG. 1, is guided into the housing of a portable, hand-held working tool provided with an air-cooled combustion engine 10 for cooling its cylinder 11. The combustion engine may also be an air-cooled two-stroke engine.

The blower fan 2 axially sucks surrounding air in the direction of the arrows 8 (FIG. 2) through the air inlet openings 16 within the blower cover 4 (FIGS. 2, 3) and conveys the air tangentially in the form of a radial blower with correspondingly shaped fan blades 17 in the rotational direction 6 of the blower fan 2 according to the air flow arrows 9 into the cooling air spiral 1.

The blower fan 2 is located on one end 12 of the crankshaft 13 of the combustion engine 10 and rotates accordingly with the revolutions of the engine. Advantageously, a straight or linear combustion air channel 20 is integrated within the blower cover 4 which extends in a plane parallel to the rotational plane of the blower fan 2 and, as can be seen especially in FIG. 1, extends in the circumferential direction over a portion of the cooling air spiral forming the cooling air channel 1. The cover 4 is adapted in size and shape to conform the the cooling air spiral. It may be expedient to provide for a separate embodiment of the combustion air channel 20 and the blower cover 4. In the shown embodiment according to FIGS. 1 to 9, the combustion air channel 20 is a linear channel which is substantially tangentially arranged relative to the blower fan 2.

The combustion air channel 20 is connected with one end which is positioned outside of the cooling air spiral 1 via a pipe socket 23 to a cylindrical connector 22 having a connecting socket 24 that opens into an expediently circularly shaped air filter chamber 49. The other end, which is positioned above the cooling air spiral 1, is provided with an air intake socket 30 extending transverse and at a slant relative to the main air flow direction 40 into the cooling air channel. The air intake socket 30 is provided with an inlet opening 25 which is substantially parallel to the inflowing cooling air. The inlet opening 25 is facing away from the blower fan 2 and is positioned in a plane 18 which is parallel to the axis of rotation 60 and forms a tangent to a circle 19 which is concentric to the axis of rotation 60 of the blower fan 2. The circle 19 is slightly greater than the diameter of the blowing fan 2.

The end of the combustion air channel 1 which is adjacent to the blowing fan 2 ends approximately on the circle 19 at the plane 18.

Starting at the bottom 21 of the combustion air channel 20 the air intake socket 30 extends substantially over the entire axial height of the cooling air channel 1. The air intake socket 30 is advantageously a unitary part of the combustion air channel 20; for example, the unitary part may be in the form of an injection-molded plastic part. The free end 31 of the air intake socket 30 in the shown embodiment is spaced at a short distance x relative to the axial inner wall 14 of the cooling air channel 1 which is formed by the housing part 50. It may also be expedient to provide a flush arrangement of the air intake socket 30 at the axial inner wall 14 of the cooling air channel.

As can be seen in the representation according to FIGS. 4 to 7, the inlet opening 25 extends in the plane 18, on the side of the air intake socket 30 which is facing away from the blower fan 2, substantially over the entire width and the entire height of the air intake socket 30. In the direction of flow of the incoming air an intake section 26 is located adjacent to the inlet opening 25 which intake section 26 has a bottom 33 which is parallel to the rotational plane of the blower fan 2. The bottom 33 is parallel to the inner wall 14 of the cooling air spiral 1. The intake section 26, which is provided with substantially parallel sidewalls, has a longitudinal center axis 27 which extends at an acute angle 28 to the main air flow direction 40. In the shown embodiment the acute angle 28 is approximately 25°. The plane 18 in which the inlet opening 25 is positioned extends parallel to the main flow direction 40. The sidewalls of the intake section 26 are perpendicular to the bottom 21 of the combustion air channel.

A transition section 29 is connected to the intake section 26 and has a bottom 32 ascending from the bottom 33 of the intake section 26 to the bottom 21 of the combustion air channel 20 (FIG. 7). In the shown embodiment the ascending angle 35 is approximately 65°. As shown especially in FIGS. 4 and 6, the sidewalls of the transition section 29, which extend substantially perpendicularly to the bottom 21 of the air intake socket, extend slightly toward one another so that the transition section 29 in the circumferential direction of the blower fan 2 tapers off, but over all widens (see FIG. 7). The longitudinal center axis 36 of the transition section 29 is arranged at an angle 34 relative to the main air flow direction 40, respectively, to the plane 18. The angle 34 is greater than the angle 28 between the plane 18 and the longitudinal center axis 27 of the intake section 26. In the shown embodiment the angle 34 is approximately 55°. The air intake socket 30 is thus angularly bent in the circumferential direction of the blower fan 2.

Figure 6:
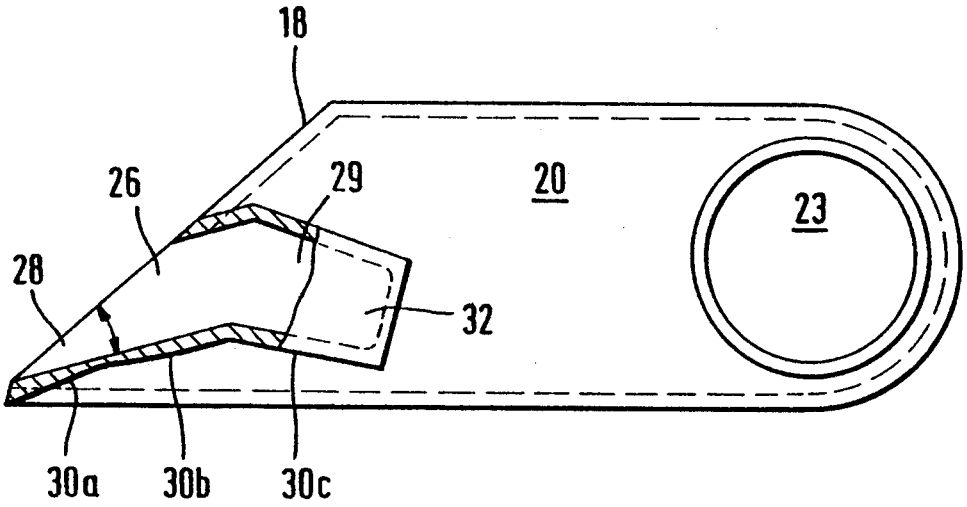
FIG. 6 shows a bottom view of the combustion air channel according to the representation of FIG. 4.

The air intake socket 30 over its axial extension has substantially the same width. As can be seen especially in FIG. 1, the width of the air intake socket 30 is approximately half the radial width of the cooling air spiral 1 whereby the air intake socket 30 is closer to the blower fan 2 than to the outer wall of the cooling air channel 1. In the shown embodiment the air intake socket 30 is positioned closely adjacent to the blower fan 2 whereby, viewed in a plan view according to FIG. 1, the combustion air channel 20 partially covers the circle described by the moving fan blades 17. The air intake socket 30 is positioned closely adjacent to the circle described by the fan blades 17 whereby, in a development in the circumferential direction of the blower fan, the substantially linear sections (intake section, transition section) have substantially the same distance to the circle described by the fan blades. For generating a narrow slot between the air intake socket 30 and the blower fan 2, the outer wall of the air intake socket 30 facing the blower fan 2 is divided in the fashion of an approximated partial circle into straight, angularly arranged wall sections 30*a*, 30*b*, 30*c* (FIG. 6).

Relative to the main air flow direction 40 in the shown embodiment according to FIGS. 1 to 9, the air inlet socket 30 is arranged within the forward quarter of the air inlet channel 1 so that only a portion of dirt particles sucked in by the cooling air blower streams past the air intake socket 30. In this manner, a deposit of dirt particles at the air intake socket 30 is minimized.

The pipe socket 23 arranged at the end of the combustion air channel 20 remote from the air intake socket 30 engages a cup-shaped connector 22 having at its periphery a connecting socket 24 for guiding the combustion air from the combustion air channel 20 into the air filter chamber 49.

When the blower fan 2 rotates, the cooling air and entrained dirt particles flow substantially in the main flow direction 40 along the outer wall of the cooling air channel 1 in the direction of the arrow 7 to the cooling air outlet 5. The combustion air enters via the inlet opening 25 the intake section 26 at the angle 28 relative to the main air flow direction 40 and is axially upwardly guided by the transition section 29 into the combustion air channel 20 arranged in a plane above the blower fan 2. Due to their mass inertia, the dirt particles entrained within the cooling air flow cannot follow the change of direction so that they remain substantially within the cooling air channel 1 and are removed with the stream of cooling air. Since the air intake socket 30 is positioned closely adjacent to the blower fan 2, a wide passage between the air intake socket 30 and the outer wall of the cooling air spiral is formed which ensures proper removal of collecting dirt particles. Since the combustion air channel 20, respectively, the air intake socket 30 are positioned on the pressure side of the cooling air blower 3 the combustion air branched off by the combustion air channel 20 is guided at a slight pressure into the air filter chamber 49 from which the combustion engine sucks the combustion air required for operation. The slight pressure favors a complete filling of the combustion chamber with the required amount of combustion air.

The embodiment according to FIGS. 10 to 15 corresponds in its basic construction to the embodiment according to FIGS. 1 to 9 so that identical parts are identified with identical reference numerals. The combustion air channel 120 is provided with a section which covers in a plane above the blower fan 2 the cooling air spiral and which extends over half, preferably more than half, of the cooling air spiral 1.

Figure 10:
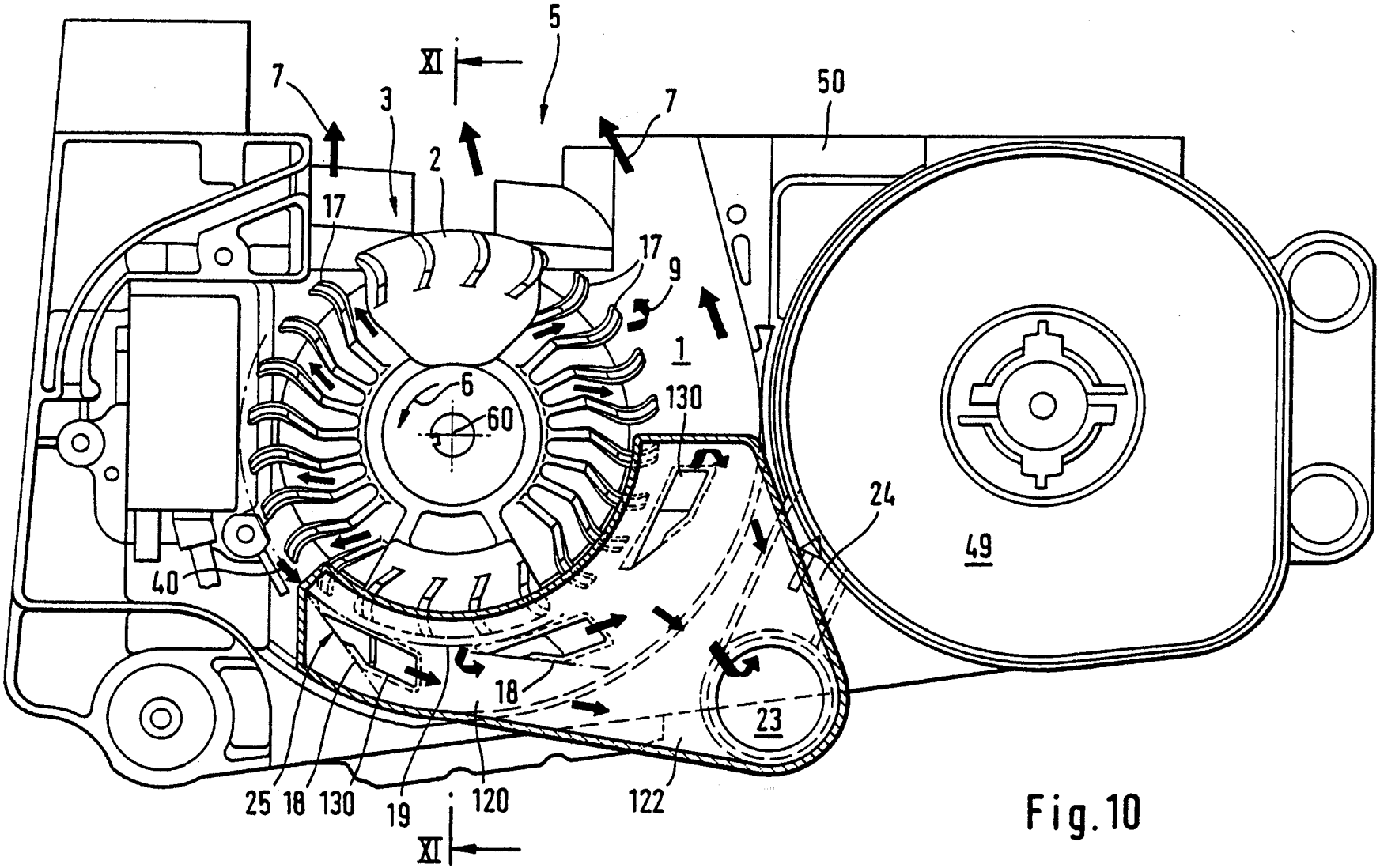
FIG. 10 shows in section a partial view of a cooling air blower arranged within a tool housing with a further embodiment of the combustion air channel.
Figure 11:
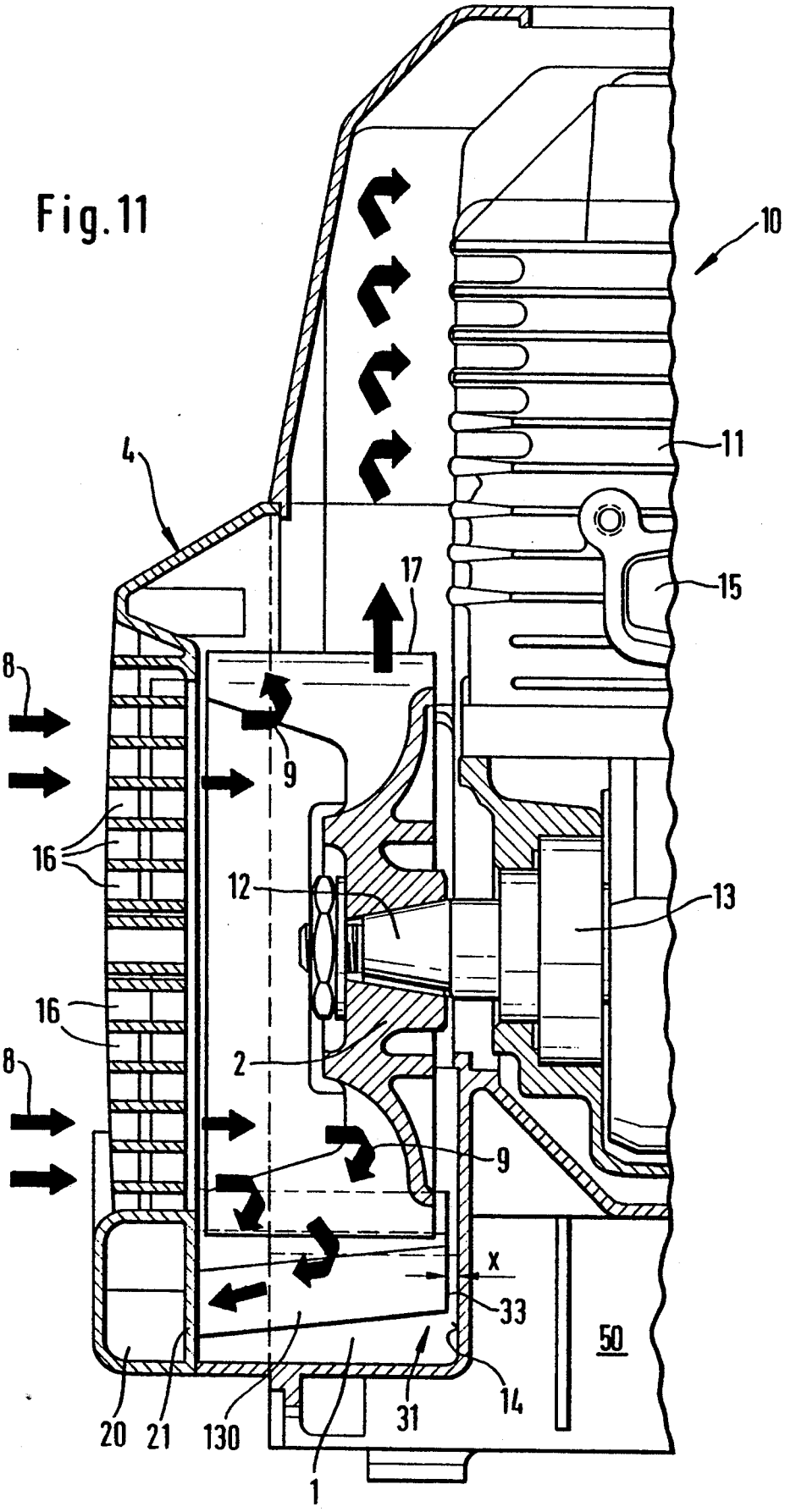
FIG. 11 shows a section along the line XI—XI in FIG. 10.
Figure 12:
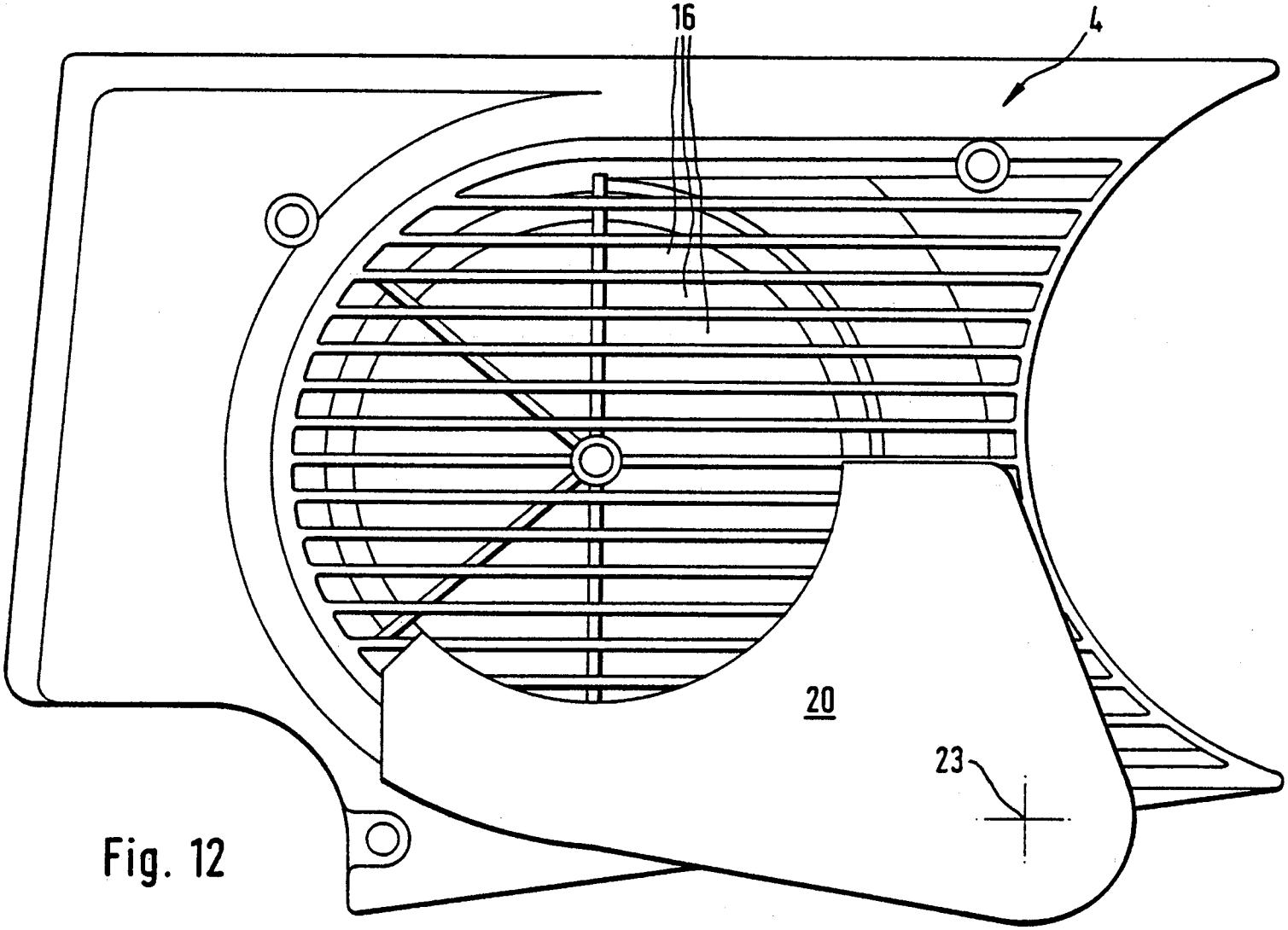
FIG. 12 shows a plan view of a cover of the cooling air blower according to FIG. 11.

Radially connected to this section of the combustion air channel 120 is a projection 122. The projection 122 connects the aformentioned section with a connector 22 positioned outside of the cooling air spiral 1 whereby this connector 22 is provided with a pipe socket 23. The connector 22 tapers off in the direction of the pipe socket 23 (FIG. 10).

Over the entire circumferential portion of approximately 65° the blower fan 2 is slightly covered by the section of the combustion air channel 120. In the longitudinal direction of the cooling air channel 1 a plurality of air intake sockets 130 is arranged at the combustion air channel 120 which are preferably spaced equidistantly in the longitudinal direction of the air cooling channel 1. The inlet openings 25 of the air intake sockets 130 are arranged in planes 18 facing away from the blower fan 2 whereby all planes 18 are tangentially arranged to a common circular section of a circle 19 concentric to the axis of rotation 60 of the blower fan 2.

Figure 13:
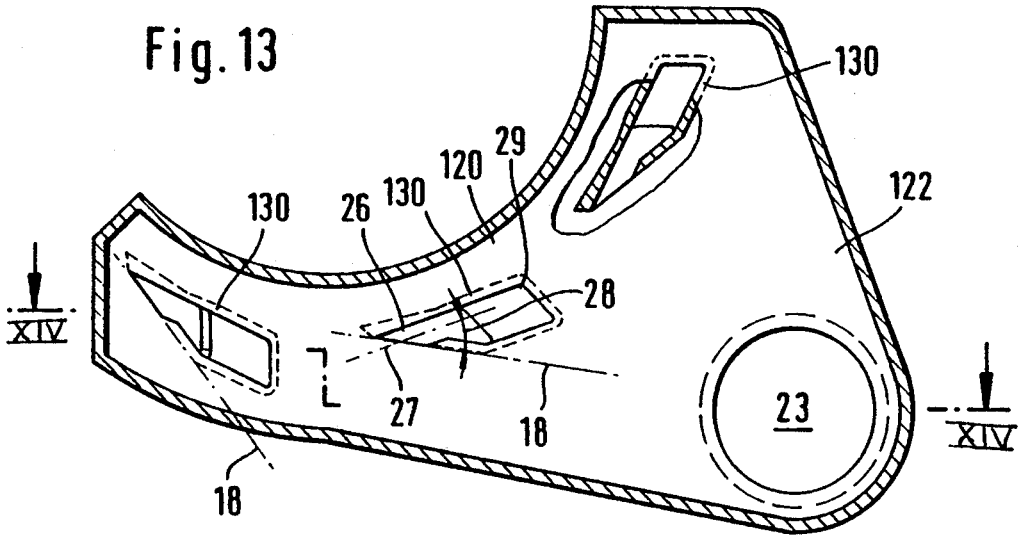
FIG. 13 is an enlarged representation of the combustion air channel according to FIG. 10.
Figure 14:
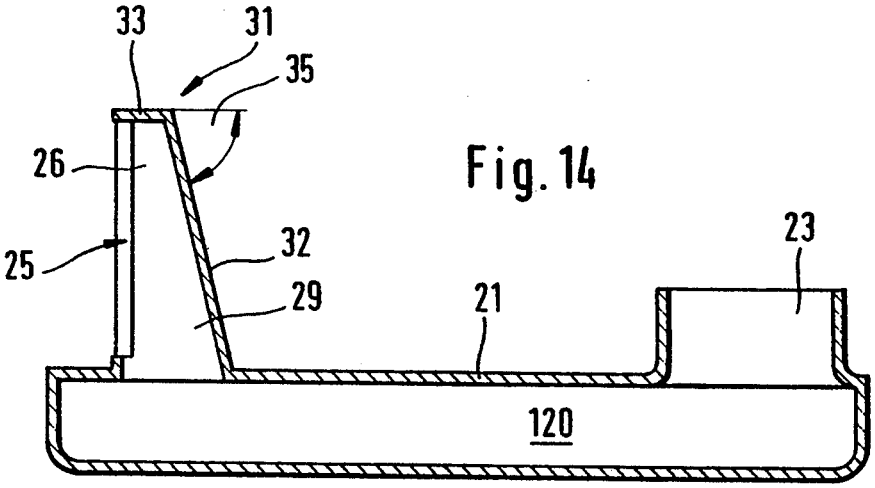
FIG. 14 shows a section along the line XIV—XIV in FIG. 13.
Figure 15:
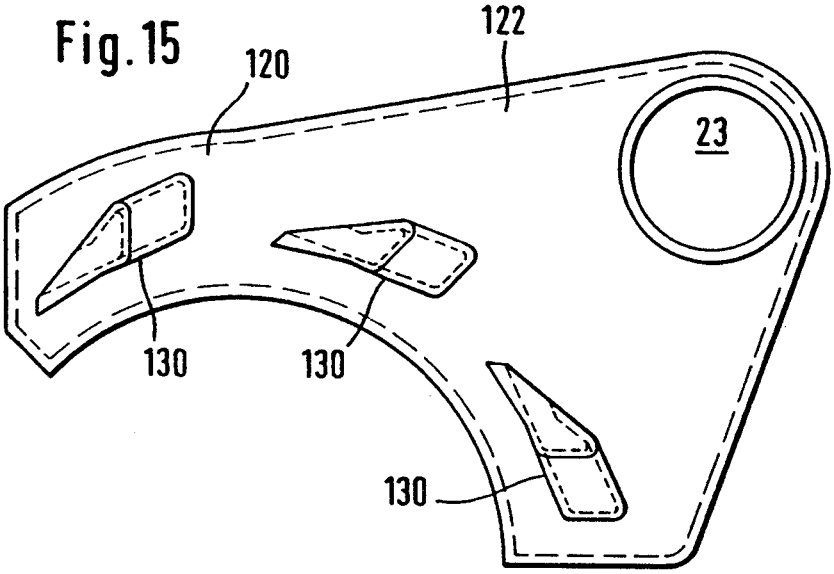
FIG. 15 shows a bottom view of the combustion air channel according to FIG. 13.

As especially shown in FIG. 13, the longitudinal center axis 27 of the intake section 26 is arranged at an angle 28 relative to the plane 18 which angle is approximately 25°. The main air flow direction within the cooling air spiral is substantially parallel to the respective planes 18.

As shown in the embodiment according to FIGS. 1 to 9, the air intake socket 130 is comprised of an intake section 26 adjacent to the inlet opening 25 and a transition section 29. The bottom 32 of the transition section 29 is positioned at a angle 35 to the bottom of the intake section, that is steeper than in the first embodiment and is preferably 75°. The combustion air is thus axially upwardly displaced over a relatively short path from the cooling air channel 1 into the combustion air channel 120 whereby the dirt particles, due to their mass inertia, cannot follow the axial upward displacement into the combustion air channel 120.

As can be taken from FIG. 13, the intake section 26 is widened relative to the inlet opening 25 so that the flow velocity of the entering air is decreased and dirt particles are largely prevented from entering the filter system.

As can be seen especially in FIG. 13, the intake section 26 and the transition section 29 are substantially linearly arranged one after another so that the air intake socket 130 is provided with a straight inner wall neighboring the blower fan 2. The incoming combustion air is thus guided substantially diagonally into the channel 120.

Figure 16:
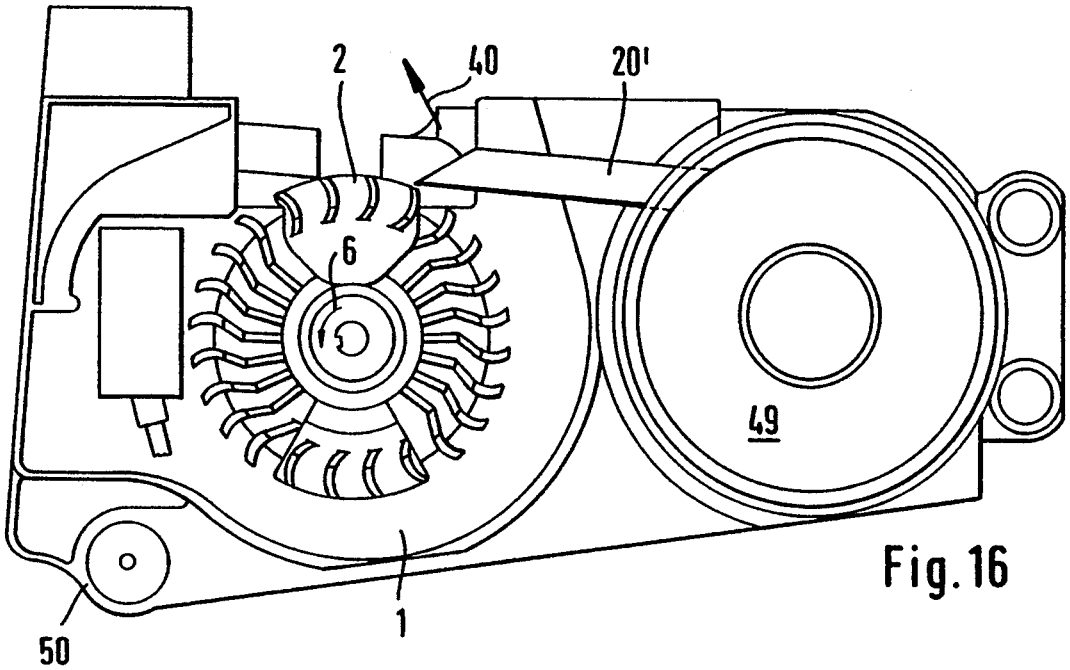
FIG. 16 shows a schematic representation of the arrangement of a combustion air channel.
Figure 17:
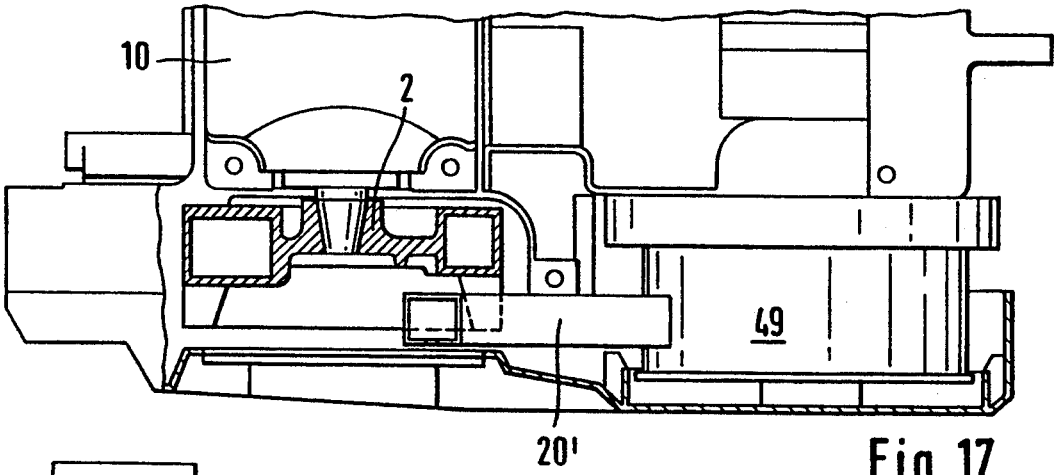
FIG. 17 shows a plan view of the arrangement according to FIG. 16.
Figure 18:
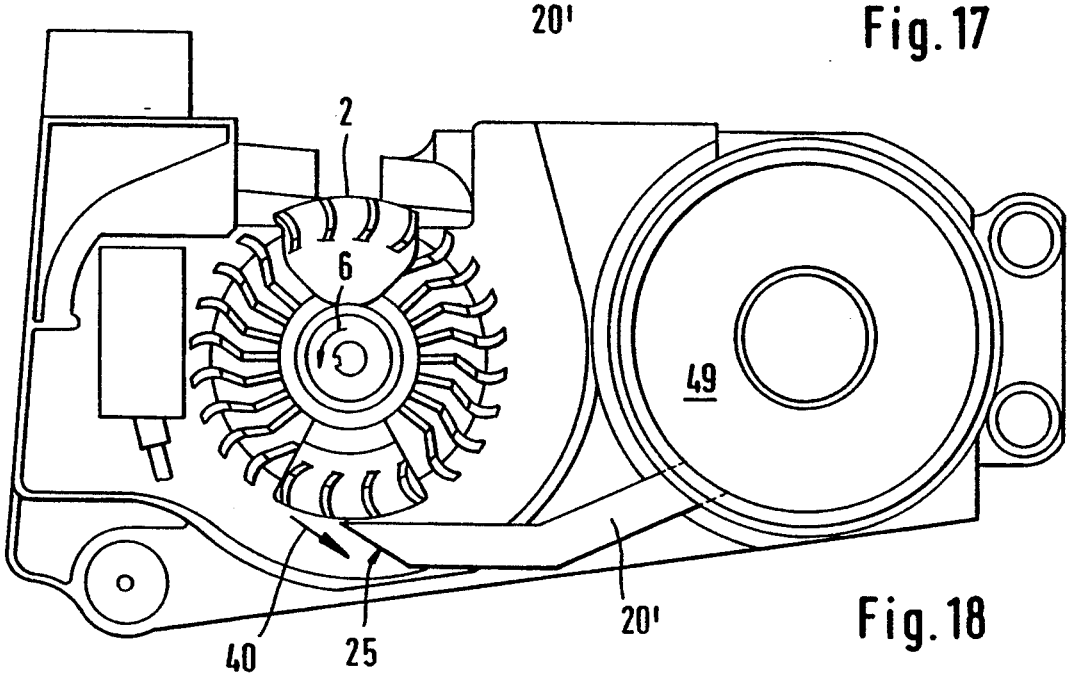
FIG. 18 is a schematic representation of a further arrangement of a combustion air channel.

As can be seen in FIGS. 16 to 18, the combustion air channel 20' may also be arranged counter to the rotational direction of the blower fan so that the branched-off combustion air is strongly deflected relative to the main direction 40. This ensures a substantially dirt particle-free combustion air, but can result in unfavorable pressure conditions within the air filter chamber 49. The preferred embodiment of the alternative arrangement of the combustion air channel 20' is the one represented in FIG. 18 in which the inlet opening 25 is facing away from the blower fan 2, in which the combustion air channel 20' however is branched off in the direction of rotation 6 of the blower fan 2. The angular change required for branching off the combustion air stream is on the one hand not very great, but on the other hand sufficient to prevent the introduction of dust into the combustion air channel.

The present invention is, of course, in no way restricted to the specific disclosure of the specification and drawings, but also encompasses any modifications within the scope of the appended claims.

What we claim is:

1. A cooling air blower for a combustion engine comprising:

a cooling air channel for supplying cooling air to a combustion engine for cooling;

a blower fan for conveying air into said cooling air channel, wherein a cooling air flow is established having a main flow direction in said cooling air channel tangential to said blower fan;

a combustion air channel branching off said cooling air channel for guiding air for combustion to an intake member of the combustion engine;

said combustion air channel having a section extending adjacent to said cooling air channel; and said combustion air channel having an air intake socket within said section, said air intake socket being narrower than said cooling air channel and, in a radial plane of said blower fan, extending transverse to said main air flow direction of the cooling air in said cooling air channel, said air intake socket positioned at a slant relative to said radial plane of said blower fan and having an inlet opening, located on a side of said intake socket facing away from said blower fan, for allowing passage of air from said cooling air channel into said combustion air channel.

2. A cooling air blower according to claim 1, wherein said air intake socket substantially extends over an entire height of said cooling air channel.

3. A cooling air blower according to claim 1, wherein said air intake socket has a free end remote from said combustion air channel, said free end being spaced at a distance from an inner wall of said cooling air channel.

4. A cooling air blower according to claim 1, wherein said inlet opening is located in a plane forming a tangent to a circle concentric to said blower fan, said circle having a diameter that is Greater than an outer diameter of said blower fan.

5. A cooling air blower according to claim 4, wherein said plane is parallel to an axis of rotation of said blower fan.

6. A cooling air blower according to claim 1, wherein said inlet opening extends over an entire width and an entire height of said air intake socket.

7. A cooling air blower according to claim 1, wherein said air intake socket has an intake section adjacent to said inlet opening, said intake section having a longitudinal center axis extending at a first angle of substantially 20° to 35° to said main air flow direction.

8. A cooling air blower according to claim 7, wherein said air intake socket has a transition section adjacent to said intake section, said transition section having a bottom portion that ascends from said intake section to said combustion air channel.

9. A cooling air blower according to claim 8, wherein said intake section and said transition section are aligned so as to extend substantially linearly relative to one another.

10. A cooling air blower according to claim 8, wherein said transition section is positioned at a second angle relative to said main air flow direction, said second angle being greater than said first angle.

11. A cooling air blower according to claim 8, wherein said blower fan has a blade tips describing a circle and wherein said transition section tapers off in a tangential direction of said blower fan.

12. A cooling air blower according to claim 1, wherein said combustion air channel has a plurality of said air intake sockets arranged one after another in a longitudinal direction of said cooling air channel.

13. A cooling air blower according to claim 12, wherein said air intake sockets are equidistantly spaced from one another.

14. A cooling air blower according to claim 1, wherein said cooling air channel has a first end and a second end, said cooling air flow being guided from said first end to said second end, said second end being an exit for said cooling air flow, wherein said air intake socket is positioned within a quarter of said cooling air channel adjacent to said first end.

* * * * *